US010232632B2

(12) United States Patent
Nakagawa

(10) Patent No.: US 10,232,632 B2
(45) Date of Patent: Mar. 19, 2019

(54) LIQUID EJECTION APPARATUS AND LIQUID EJECTION HEAD

(71) Applicant: CANON KABUSHIKI KAISHA, Tokyo (JP)

(72) Inventor: Yoshiyuki Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/598,034

(22) Filed: May 17, 2017

(65) Prior Publication Data

US 2017/0341404 A1 Nov. 30, 2017

(30) Foreign Application Priority Data

May 30, 2016 (JP) ..... 2016-107296

(51) Int. Cl.
*B41J 2/175* (2006.01)

(52) U.S. Cl.
CPC ..... *B41J 2/17553* (2013.01)

(58) Field of Classification Search
CPC ..... B41J 2/17553
See application file for complete search history.

(56) References Cited

U.S. PATENT DOCUMENTS

| | | | | |
|---|---|---|---|---|
| 5,933,168 | A * | 8/1999 | Sakai | B41J 2/04541 347/10 |
| 7,156,507 | B2 * | 1/2007 | Aruga | B41J 2/17509 347/85 |
| 10,005,288 | B2 | 6/2018 | Aruga et al. | B41J 2/17596 |
| 2016/0059547 | A1 * | 3/2016 | Kaneko | B41J 2/04563 347/14 |

FOREIGN PATENT DOCUMENTS

| | | |
|---|---|---|
| CN | 1832860 | 9/2006 |
| EP | 0271905 | 6/1988 |
| EP | 0575204 | 12/1993 |
| EP | 0648606 | 4/1995 |
| EP | 0728583 | 8/1996 |
| EP | 0596530 | 7/1997 |
| JP | 3606282 | 1/2005 |

OTHER PUBLICATIONS

U.S. Appl. No. 15/382,027, filed Dec. 16, 2016.
Chinese Office Action dated Dec. 20, 2018 in counterpart Chinese Application No. 201710386357.1, with English translation.

* cited by examiner

*Primary Examiner* — Julian D Huffman
*Assistant Examiner* — Michael Konczal
(74) *Attorney, Agent, or Firm* — Venable LLP

(57) ABSTRACT

An object is to provide a liquid ejection apparatus that allows suppression of a fluctuation in a pressure of a liquid in a flow path caused by a liquid delivery unit, enabling the liquid to be stably ejected through an ejection port. The liquid ejection apparatus including a liquid ejection head having an ejection port through which a liquid is ejected, a flow path configured to communicate with the ejection port, and a liquid delivery unit configured to feed the liquid to the flow path. A relation between an angular frequency ω of the liquid delivered from the liquid delivery unit, a coefficient of kinematic viscosity ν of the liquid, and an equal diameter a of at least a part of a section of an extra-head flow path in a direction normal to a direction in which ink flows satisfies $\sqrt{(\omega/2\nu)}\times a>1$.

13 Claims, 13 Drawing Sheets

LIQUID EJECTION APPARATUS AND LIQUID EJECTION HEAD

BACKGROUND OF THE INVENTION

Field of the Invention

The present invention relates to a liquid ejection apparatus that ejects a liquid through ejection ports in a liquid ejection head for printing, and to the liquid ejection head.

Description of the Related Art

Liquid ejection apparatuses that eject a liquid such as ink for printing are known to suffer the following problems in a case where the position of meniscus in each ejection port fluctuates.

(1) The amount (i.e., volume) of droplets ejected through the ejection ports varies, leading to color unevenness in a formed image.

(2) The speed of droplets ejected through the ejection ports (ejection speed) varies with respect to the moving speed of a print medium relative to the ejection ports. This varies landing accuracy for droplets landing on the print medium, deteriorating image quality.

A cause of these problems is a fluctuation in a dynamic pressure (pressure loss) in a liquid supply flow path. For example, in a case where a liquid is fed using a liquid delivery mechanism such as a pump, pulsation generally occurs to fluctuate the dynamic pressure of the liquid. This in turn fluctuates the position of meniscus in each ejection port, leading to the likelihood of problems as described in 1) and 2), above.

Japanese Patent No. 3606282 discloses a technique intended to suppress a fluctuation in the dynamic pressure in the liquid supply flow path. Japanese Patent No. 3606282 adopts a configuration in which a valve is provided in a supply path through which a liquid is fed to a liquid ejection head, to open or occlude the supply path based on a negative pressure in a pressure chamber, thus suppressing a fluctuation in negative pressure.

However, the technique disclosed in Japanese Patent No. 3606282 needs a complicated mechanism to actuate the valve, disadvantageously resulting in increased costs.

SUMMARY OF THE INVENTION

An object of the present invention is to provide a liquid ejection apparatus and a liquid ejection head that allows suppression of a fluctuation in the pressure of a liquid in a flow path caused by a liquid delivery unit, enabling the liquid to be stably ejected through ejection ports.

An aspect of the present invention provides a liquid ejection apparatus including a liquid ejection head having an ejection port through which a liquid is ejected, a flow path configured to communicate with the ejection port, and a liquid delivery unit configured to feed the liquid to the flow path. A relation between an angular frequency $\omega$ of the liquid delivered from the liquid delivery unit and a coefficient of kinematic viscosity $\nu$ of the liquid and an equal diameter (a) of at least a part of the flow path satisfies $\sqrt{(\omega/2\nu)}\times a>1$.

In the aspect of the present invention, a fluctuation in the pressure of the liquid in the flow path caused by the liquid delivery unit can be suppressed, enabling the liquid to be stably ejected through the ejection ports.

Further features of the present invention will become apparent from the following description of exemplary embodiments with reference to the attached drawings.

DESCRIPTION OF THE EMBODIMENTS

A liquid ejection apparatus according to embodiments of the present invention will be described below with reference to the drawings. A liquid ejection head that ejects a liquid such as ink according to the present invention and a liquid ejection apparatus with the liquid ejection head mounted therein are applicable to apparatuses such as a printer, a copier, a facsimile machine having a communication system, and a word processor having a printer unit, and industrial printing apparatuses combined with various processing apparatuses. The liquid ejection head and the liquid ejection apparatus may be used, for example, for applications such as production of biochips, printing of electronic circuits, and fabrication of semiconductor substrates. The embodiment described below is subject to various technically preferable conditions. However, the present invention is not limited to these conditions so long as the concepts of the present invention are satisfied.

(First Embodiment)

FIGS. 1 to 7 are diagrams depicting a first embodiment of a liquid ejection apparatus according to the present invention. In the present embodiment, as the liquid ejection apparatus, an ink jet printing apparatus (hereinafter simply referred to as a printing apparatus) that ejects ink onto a print medium to form an image thereon will be described by way of example. The ink as used herein includes not only a liquid containing a coloring material used to form an image on a print medium but also a treatment liquid intended to improve fixability and weatherability of the image formed on the print medium.

Figure 1:
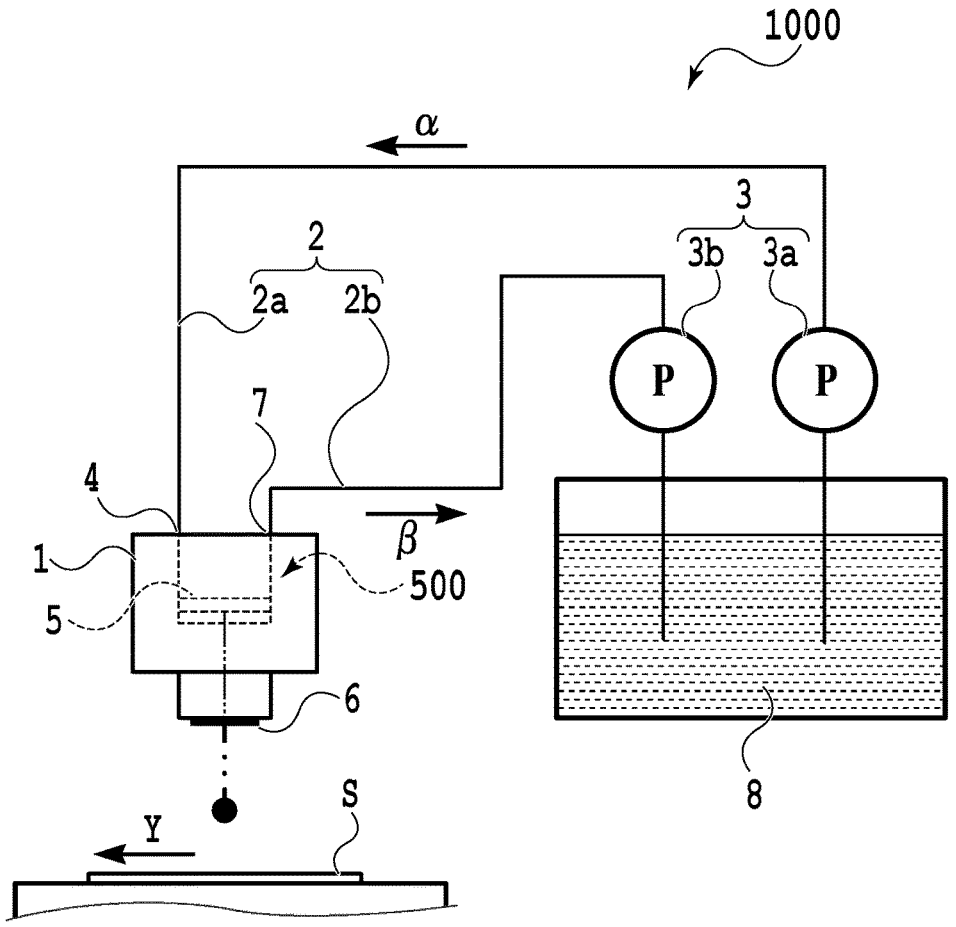
FIG. 1 is a schematic diagram depicting a basic configuration of a printing apparatus in the present embodiment.

FIG. 1 is a schematic diagram depicting a basic configuration of a printing apparatus 1000 in the present embodiment. The printing apparatus 1000 includes a liquid ejection head 1 and a liquid storage 8 that stores ink to be fed to the liquid ejection head 1. The printing apparatus 1000 further includes an extra-head flow path 2 that couples the liquid storage 8 and the liquid ejection head 1 together and a liquid delivery unit 3 that allows ink to flow through the extra-head flow path 2.

The extra-head flow path 2 in the present embodiment includes an upstream flow path 2*a* through which a liquid flows from the liquid storage (liquid supply source) 8 to the liquid ejection head 1, and a downstream flow path 2*b* through which the liquid flows from the liquid ejection head 1 to the liquid storage 8. The liquid delivery unit 3 includes a pump 3*a* connected to the upstream flow path 2*a* and a pump 3*b* connected to the downstream flow path 2*b*. In a case where the two pumps 3*a*, 3*b* need not be distinguished from each other, the pumps may be collectively referred to as the pump 3.

Figure 2A:
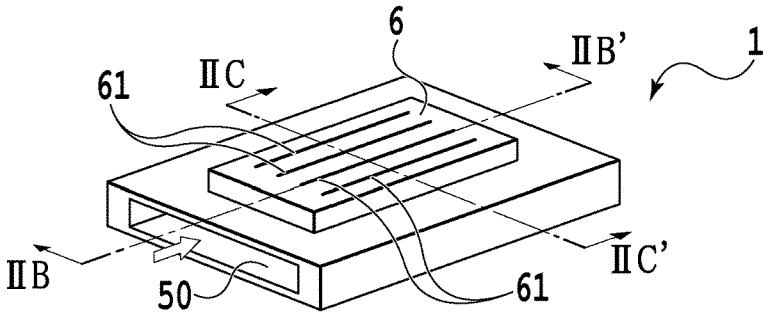
FIGS. 2A to 2D are diagrams depicting a liquid ejection head for use in the present embodiment.
Figure 2B:
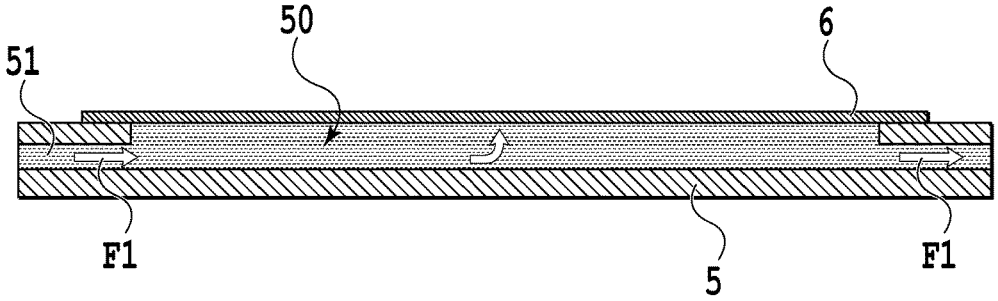
Figure 2C:
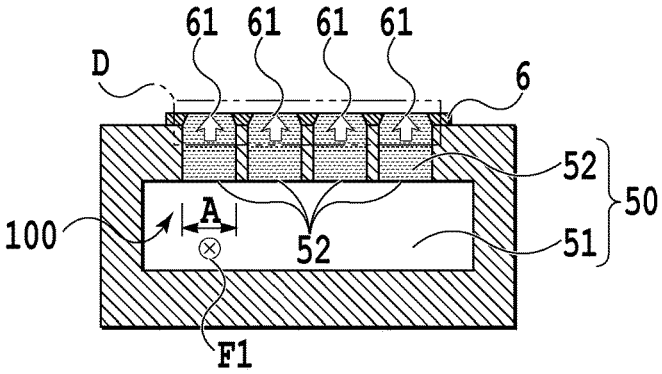
Figure 2D:
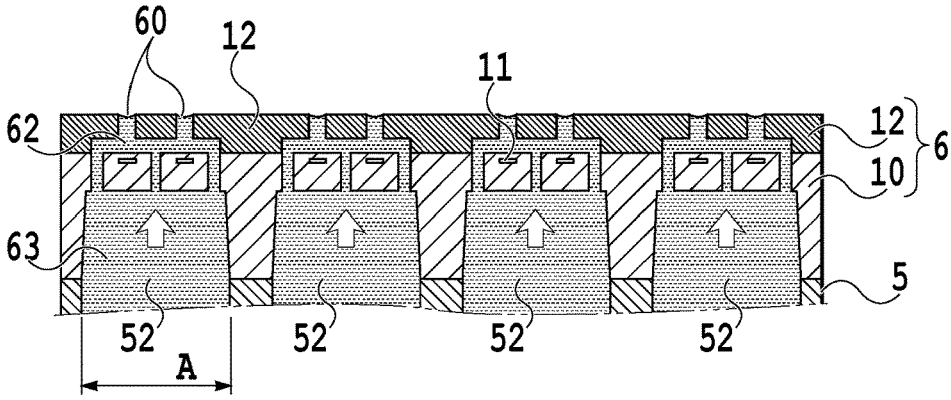

FIGS. 2A to 2D are perspective views depicting the liquid ejection head 1 for use in the present embodiment. FIG. 2A is a perspective view, FIG. 2B is a sectional view taken along IIB-IIB' in FIG. 2A, FIG. 2C is a sectional view taken along line IIC-IIC' in FIG. 2A, and FIG. 2D is an enlarged view of a portion D in FIG. 2C. As depicted in FIG. 2A, the liquid ejection head 1 includes a printing element substrate 6 in which a plurality of (in FIG. 2A, four) ejection port arrays 61 each with a plurality of ejection ports 60 (see FIG. 2D) arranged therein is arranged, and a flow path plate 5 serving as a flow path forming member. The flow path plate 5 is provided with a common flow path 51 through which ink flows in the direction of arrow F1 as depicted in FIGS. 2A, 2B and a plurality of (in FIG. 2C, four) discrete flow paths 52 through which the common flow path 51 communicates discretely with the ejection port arrays 61. One end of the common flow path 51 communicates with the upstream flow path 2*a*, and the other end of the common flow path 51 communicates with the downstream flow path 2*b*. The common flow path 51 and the discrete flow paths 52 formed in the flow path plate 5 are also collectively referred to as an intra-plate flow path 50.

As depicted in FIG. 2D, the printing element substrate 6 includes an ejection port forming member 12 with the ejection ports 60 formed therein through which ink is ejected, and a heater board 10 provided with ejection energy generating elements (hereinafter referred to as printing elements) 11 that allow the ink to be ejected through the ejection ports 60. As the printing elements, electrothermal transducing elements (heaters), elecromechanical transducing elements (piezoelectric elements), or the like are applicable. In the present embodiment, heaters are used. Each of the printing element substrates 6 has a pressure chamber 62 formed in an area where the printing elements 11 face the ejection ports 60. The pressure chamber 62 communicates with the discrete flow path 52 formed in the flow path plate 5 via an intra-element-substrate flow path 63. The intra-plate flow path 50 and the intra-element-substrate flow path 63 form an intra-head flow path 100.

As described above, the printing apparatus 1000 in the present embodiment includes, as flow paths through which ink is fed to the ejection ports 60 in the liquid ejection head 1, the extra-head flow path 2 formed outside the liquid ejection head 1 and the intra-head flow path 100 formed in the liquid ejection head 1.

The printing apparatus 1000 includes a conveying mechanism that moves a print medium S relative to the liquid ejection head 1. In the present embodiment, the printing apparatus 1000 is of a serial type that prints the print medium S by ejecting an ink droplet dr while moving the liquid ejection head 1 in a direction (orthogonal to the sheet of FIG. 1) orthogonal to a conveying direction (Y direction) of the print medium S. However, the present invention is not limited to the serial printing apparatus but is applicable to a full-line printing apparatus that performs printing while consecutively feeding print media, using a long liquid ejection head with ejection ports arranged over a range larger than the width of the print medium.

In the above-described configuration, the pumps 3*a*, 3*b* are driven to feed the ink stored in the liquid storage 8, via the upstream supply flow path 2*a*, to the common flow path 51 formed in the flow path plate 5 in the liquid ejection head 1, as depicted by arrow α. A portion of the ink having flowed in the common flow path 51 is fed to the intra-element-substrate flow paths 63 via the discrete flow paths 52. The ink fed to the intra-element-substrate flow path 63 is further fed to the pressure chambers 62 and the ejection ports 60. Consequently, meniscus is formed in the ejection ports 60. The remaining ink in the common flow path 51 is collected in the liquid storage 8 via the downstream flow path 2*b* and the pump 3*b* as depicted by arrow β.

During a printing operation, the heaters serving as printing elements are driven to heat the ink in the pressure chambers 62 to generate bubbles in the pressure chambers 62. Pressure resulting from generation of the bubbles allows droplets of the ink to be ejected through the ejection ports 60, in each of which meniscus is formed.

The ink flowing through the extra-head flow path 2 and the intra-head flow path 100 in the printing apparatus 1000 suffers a pressure loss as a result of frictional resistance offered by an inner surface of each flow path.

In general, a pressure loss in a fluid flowing through a flow path is expressed by the following equation based on a relation between flow path resistance and an ink flow rate.

$$\Delta P = R \times Q \quad \text{(Equation 1)}$$

ΔP: pressure loss

R: flow path resistance

Q: ink flow rate

In this case, for the flow path resistance R, the following equation is generally used which derives the flow path resistance R based on a Hagen-Poiseuille flow corresponding to a steady flow through a conduit (flow path).

$$R = 128 \times \eta \times L / (\pi \times a^4) \quad \text{(Equation 2)}$$

H: ink viscosity

L: length of the conduit

A: equivalent diameter of the conduit

Figure 3:
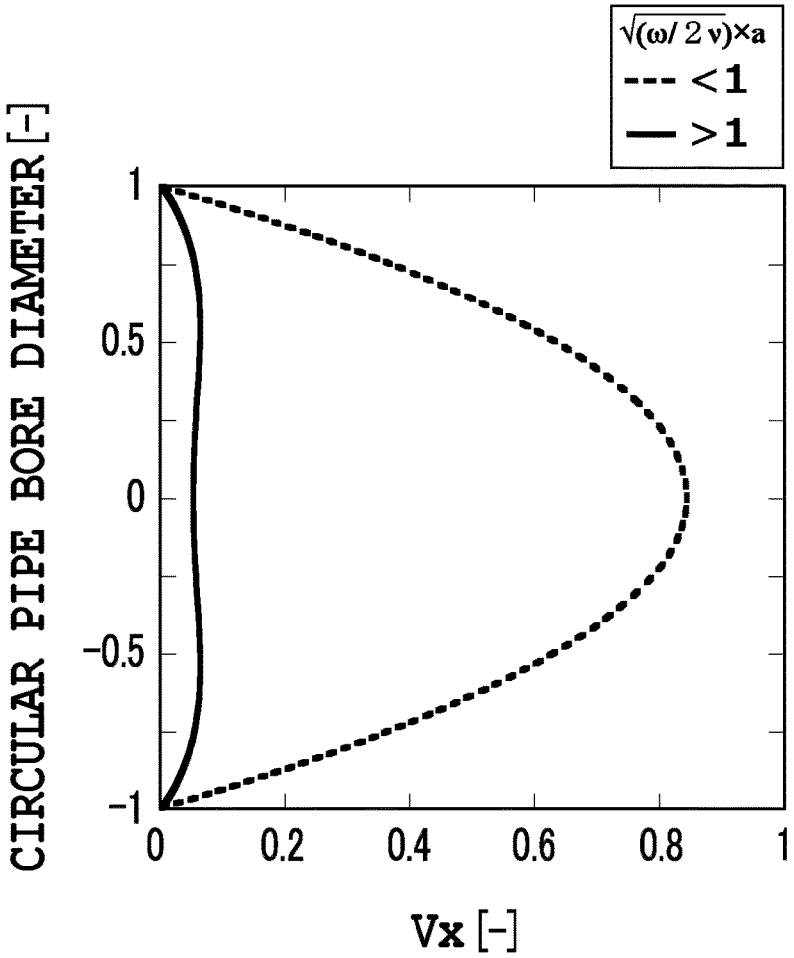
FIG. 3 is a graph illustrating a variation in flow velocity distribution resulting from a variation in indicator.

However, a liquid delivered by the pumps 3*a*, 3*b* as depicted in FIG. 1 is known to become a pulsatile flow subject to a periodically varying pressure. The pulsatile flow is not a Hagen-Poiseuille flow formed under a constant pressure but is an intra-pipe unsteady flow (harmonic oscillation flow). In particular, an unsteady flow velocity distribution formed in a fluid in a circular pipe with a uniform section is known to vary according to the magnitude of the following indicator.

$$\text{Indicator: } \sqrt{(\omega/2\nu)} \times a \quad \text{(Equation 3)}$$

ω: angular frequency of pulsation

ν: coefficient of kinematic viscosity of ink a: equivalent diameter of the conduit FIG. 3 is a graph illustrating a variation in flow velocity distribution resulting from a variation in the indicator $\sqrt{(\omega/2\nu)} \times a$. In the graph, the axis of abscissas indicates flow velocity, and the axis of ordinate indicates a normalized dimension of a circular pipe. The graph represents examples of transient flow velocity distributions resulting from a variation in the indicator $\sqrt{(\omega/2\nu)}\times a$.

Figure 4:
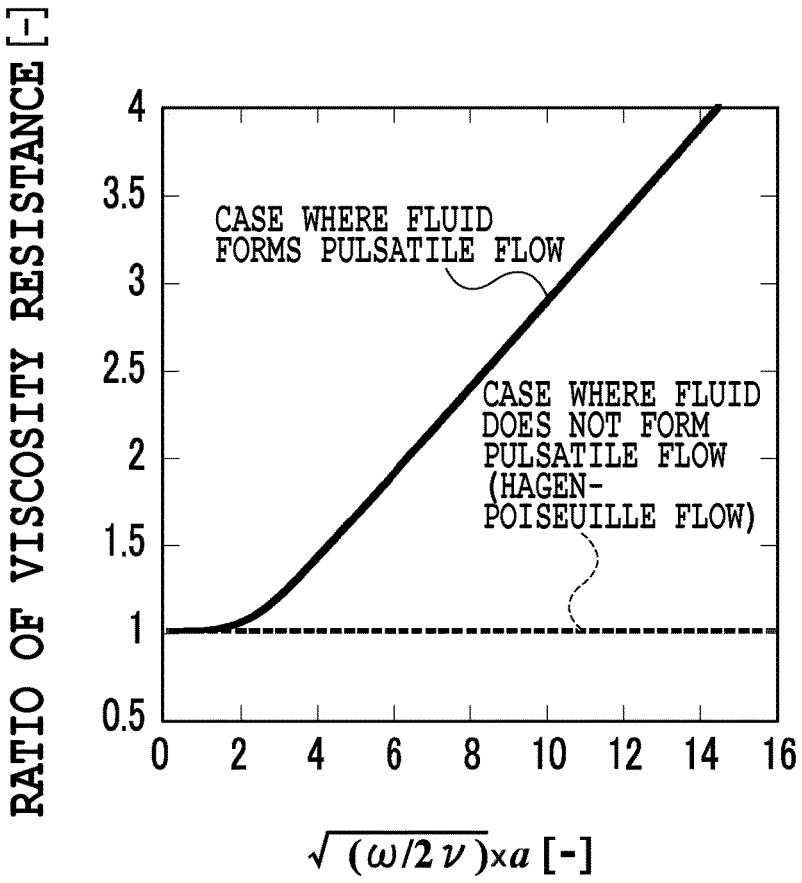
FIG. 4 is a graph illustrating ratio of viscous resistance resulting from a variation in the indicator.

FIG. 4 is a graph illustrating ratio of viscosity resistance resulting from a variation in the indicator $\sqrt{(\omega/2\nu)}\times a$. In FIG. 4, the axis of abscissas indicates the indicator $\sqrt{(\omega/2\nu)}\times a$, and the axis of ordinate indicates ratio of viscosity resistance (viscosity resistance in an intra-pipe unsteady flow/viscosity resistance in a steady flow (Hagen-Poiseuille flow). A state with a ratio of viscosity resistance of 1 on a curve in the graph (the state represented by a dashed line in the graph) indicates the viscosity resistance obtained in a case where the fluid forms a Hagen-Poiseuille flow). In contrast, a continuous line in the graph indicates that the fluid forms an intra-pipe unsteady flow.

Figure 5:
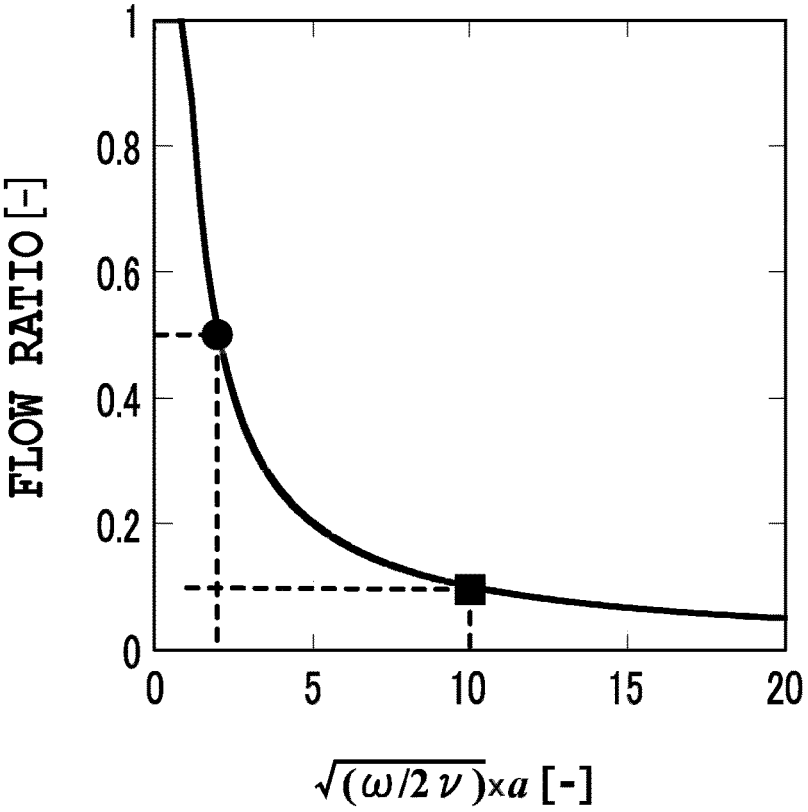
FIG. 5 is a graph illustrating a flow ratio resulting from a variation in the indicator.

FIG. 5 is a graph illustrating a flow ratio resulting from a variation in the indicator $\sqrt{(\omega/2\nu)}\times a$. In FIG. 5, the axis of abscissas indicates the indicator $\sqrt{(\omega/2\nu)}\times a$, and the axis of ordinate indicates the flow ratio (the flow rate of an intra-pipe unsteady flow/the flow rate of a steady flow (Hagen-Poiseuille flow). A flow ratio of 1 indicates that the fluid forms a Hagen-Poiseuille flow (the flow rate obtained during non-vibration).

As depicted in FIG. 3, FIG. 4, and FIG. 5, the indicator $\sqrt{(\omega/2\nu)}\times a$ has the following features.

Feature 1 (indicator <1)

Flow velocity distribution: similar to the flow velocity distribution for a Hagen-Poiseuille flow (see FIG. 3).

Ratio of viscosity resistance: similar to the ratio of viscosity resistance for a Hagen-Poiseuille flow (see FIG. 4).

Flow ratio: similar to the flow ratio for a Hagen-Poiseuille flow (see FIG. 5).

Feature 2 (indicator >1)

Flow velocity distribution: a difference from the flow velocity distribution for a Hagen-Poiseuille flow increases consistently with the value of the indicator (see FIG. 3).

Ratio of viscosity resistance: increases above the ratio of viscosity resistance for a Hagen-Poiseuille flow consistently with the value of the indicator (see FIG. 4).

Flow ratio: decreases below the flow ratio for a Hagen-Poiseuille flow with increasing value of the indicator (see FIG. 5).

For Feature 2, the flow ratios obtained in cases where the indicator is 2, 5, and 10 correspond approximately to half, one-fifth, and one-tenth, respectively, of the flow ratio for the Hagen-Poiseuille flow. Therefore, a radially enlarged component having an inner surface with such an equivalent diameter as makes the indicator larger than 1 is provided at least in a part of the extra-head flow path 2 provided with the pumps 3*a*, 3*b*. That is, the radially enlarged component is provided in a part of one or both of the upstream flow path 2*a* and the downstream flow path 2*b* or in all of the upstream flow path 2*a* and the downstream flow path 2*b*. In other words, the radially enlarged component satisfying the above-described relation may have a length at which a steady flow can be formed and need not cover the entire flow path. In the present embodiment, the indicator for the intra-head flow path 100 is smaller than 1 ($\sqrt{(\omega/2\nu)}\times a<1$).

Since the radially enlarged component for which the indicator is larger than 1 is formed in the extra-head flow path 2 as described above, the flow velocity of a liquid flowing through the extra-head flow path 2 is suppressed, thus restraining the pressure in the discrete flow paths communicating with the ejection ports. This in turn suppresses a fluctuation in the pressure in the ejection ports and displacement of meniscus, thus restraining an ejection volume fluctuation $\Delta Vd$ related to ejection through the ejection ports.

The following are the results of measurements of a fluctuation in the pressure in a common flow path 5*a*, a relation between the effective diameter of the common flow path 5*a* and the indicator, an ejection volume fluctuation related to the common flow path, and the like.

Figure 6:
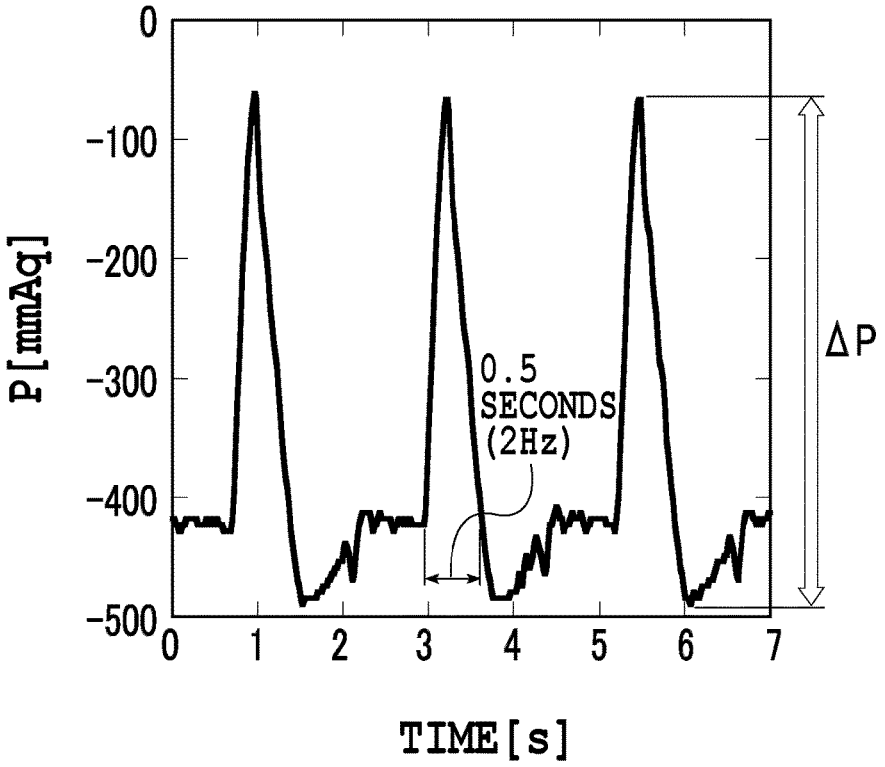
FIG. 6 is a graph indicating a measured value for a fluctuation in pressure resulting from pressure pulsation of the pump.

FIG. 6 is a diagram illustrating measured values of a fluctuation in pressure resulting from pressure pulsation caused by the pumps 3*a*, 3*b* used in the present embodiment. The measurements involve a fluctuation in the pressure in the common flow path 5*a* in the flow path plate 5 resulting from driving of the pumps 3*a*, 3*b* in the configuration provided with the extra-head flow path 2 for which the indicator is smaller than 1. FIG. 6 indicates that a period with the maximum amplitude for the pumps 3*a*, 3*b* is approximately 0.5 seconds (close to 2 Hz).

Figure 7:
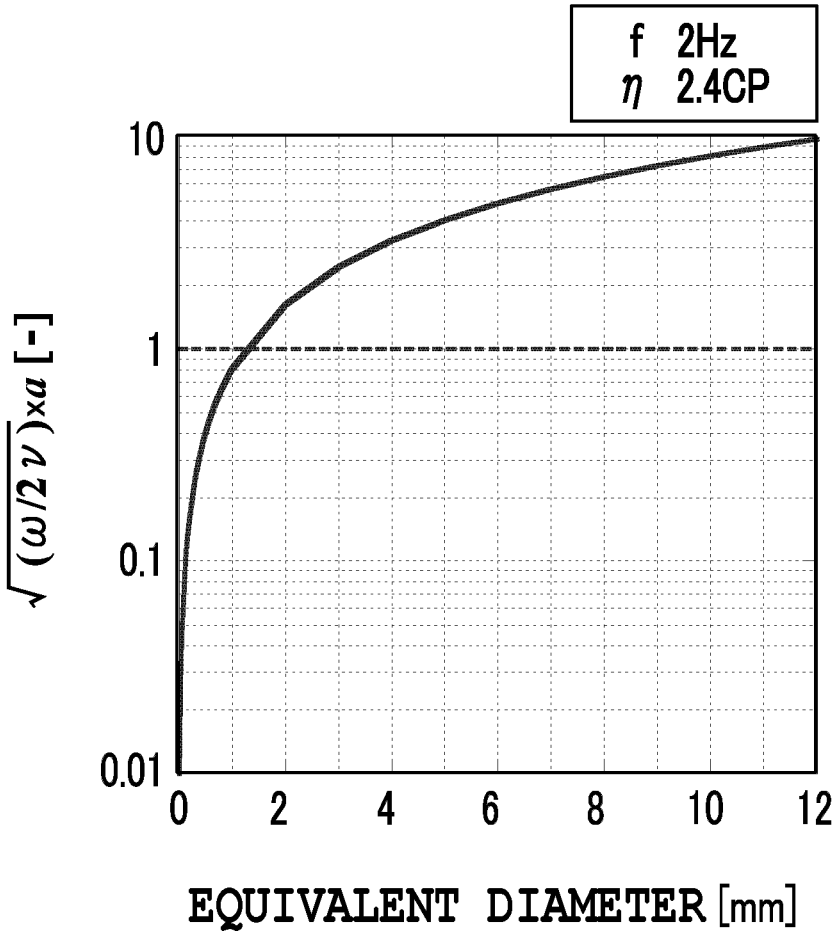
FIG. 7 is a graph illustrating a relation between an indicator and a maximum equivalent diameter of an extra-head flow path obtained in a case where ink is allowed to flow by the pump.

FIG. 7 is a graph illustrating a relation between a maximum equivalent diameter of the extra-head flow path 2 and the indicator $\sqrt{(\omega/2\nu)}\times a$ observed in a case where ink with a coefficient of kinematic viscosity (viscosity 2.4 cP/density 1 μg/μm3) is allowed to flow by the pumps 3*a*, 3*b* exhibiting a pulsation frequency of 2 Hz.

In connection with FIG. 8, a pulsation suppression effect will be described below which is exerted in a case where, for the maximum equivalent diameter of the extra-head flow path 2, the following three types of maximum equivalent diameter are set.

In a case where the ink flow path has a maximum equivalent diameter of 1 mm or less In this case, the indicator ($\sqrt{(\omega/2\nu)}\times a$)<1 as illustrated in FIG. 7, and thus, the flow ratio is 1, as illustrated in FIG. 5. Consequently, no effect is exerted which suppresses pulsation of a harmonic oscillation flow.

In a case where the ink flow path has a maximum effective diameter (equivalent diameter) of 2.5 mm In this case, the indicator ($\sqrt{(\omega/2\nu)}\times a$)=2 as illustrated in FIG. 7, and thus, the flow ratio is 0.5, as illustrated in FIG. 5. Consequently, the pulsation of the harmonic oscillation flow is reduced approximately to half.

In a case where the ink flow path has a maximum effective diameter of 12.0 mm

In this case, the indicator ($\sqrt{(\omega/2\nu)}\times a$)=10 as illustrated in FIG. 7, and thus, the flow ratio is 0.1, as illustrated in FIG. 5. Consequently, the pulsation of the harmonic oscillation flow is reduced approximately to one-tenth.

Figure 8:
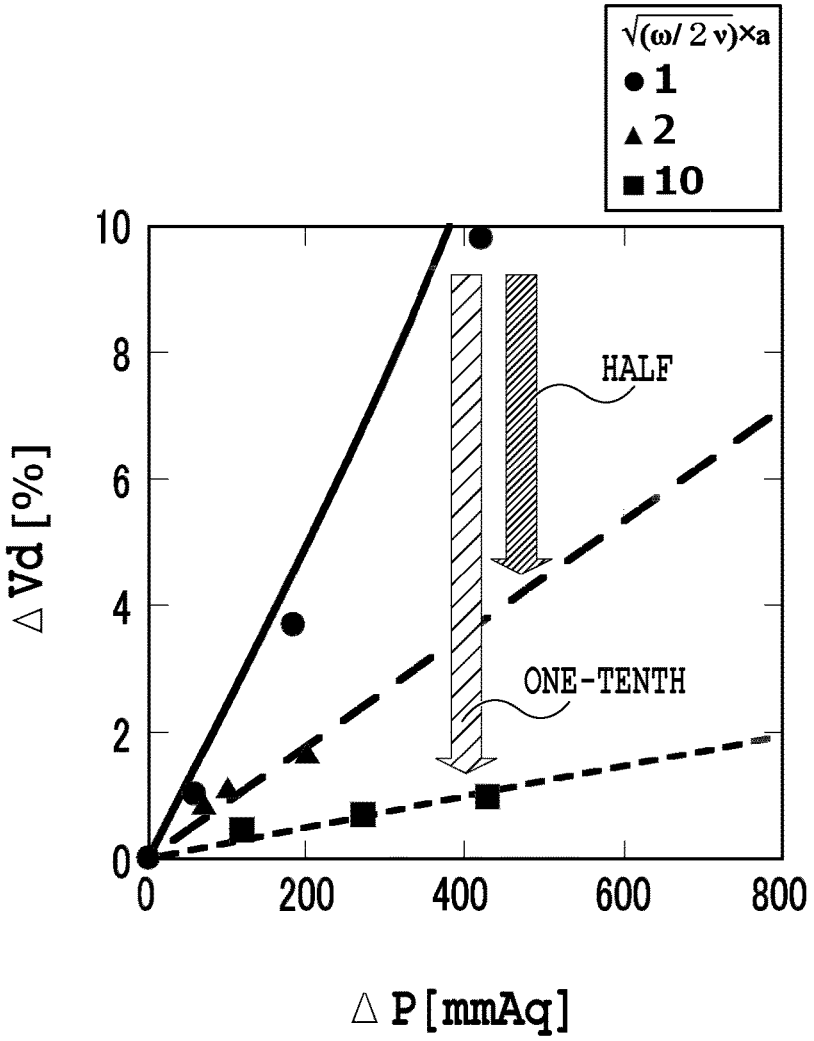
FIG. 8 is a graph illustrating a pulsation suppression effect exerted in a case where, for the maximum equivalent diameter of the extra-head flow path, three types of equivalent diameters are set.

FIG. 8 is a graph illustrating the value of the ejection volume fluctuation $\Delta Vd$ with respect to the pressure $\Delta P$ in cases where the equivalent diameter (maximum equivalent diameter) of the common channel 5*a* in the flow path plate 5 is set to 1 mm, 2.5 mm, and 12.0 mm as illustrated in FIG. 7 and the indicator ($\sqrt{(\omega/2\nu)}\times a$) is set to 1, 2, and 10. As illustrated in FIG. 8, the value of the ejection volume fluctuation observed in a case where the indicator ($\sqrt{(\omega/2\nu)}\times a$) is set to 2 for each pressure fluctuation value $\Delta P$ is reduced to half of the value of the ejection volume fluctuation observed in a case where the indicator is set to 1, and the value of the ejection volume fluctuation observed in a case where the indicator is set to 10 for each pressure fluctuation value $\Delta P$ is reduced to one-tenth of the value of the ejection volume fluctuation observed in a case where the indicator is set to 1. This indicates that, even with the same pressure fluctuation (pulsation) $\Delta P$, a reduction in the value of the ejection volume fluctuation $\Delta Vd$ increases consistently with the value of the indicator set based on the equivalent diameter of the extra-head flow path.

Therefore, in the present embodiment, in the printing apparatus in which a pulsatile flow results from flow of the liquid allowed by the pumps 3*a*, 3*b*, a pressure loss in each intra-element-substrate flow path 63 can be suppressed. As a result, possible displacement of meniscus in each ejection port can be suppressed, enabling restraint of a fluctuation in the volume of ink ejected through the ejection ports. Furthermore, the diameter of the intra-element-substrate flow path 63 can be reduced as needed regardless of a pressure fluctuation caused by the pumps 3*a*, 3*b*, enabling a reduction in the size of the printing element substrate 6.

(Second Embodiment)

Figures 9A, 9B, 9C:
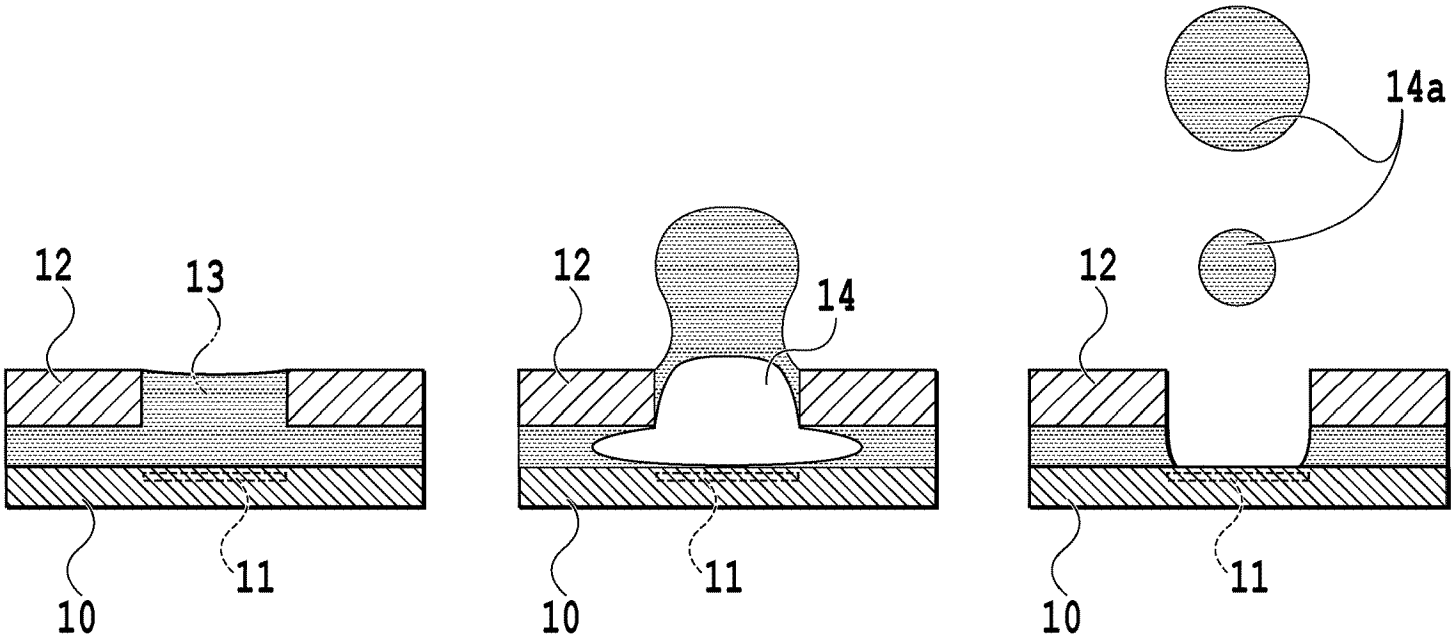
FIGS. 9A to 9C are schematic diagrams illustrating a liquid ejection operation performed by a liquid ejection head in a second embodiment.

Now, a second embodiment of the present invention will be described with reference to FIGS. 9A to 9C. FIGS. 9A to 9C are schematic diagrams depicting the printing element 11 and components around the ejection port. FIG. 9A illustrates a state before ink ejection, FIG. 9B illustrates a state during ink ejection, and FIG. 9C illustrates a state after ink ejection.

The present embodiment has an efficient configuration in which 70% or more, that is, substantially all of ink (liquid) 13 on an energy generating element in the pressure chamber changes to an ink droplet (droplet) 14*a*, which is then ejected. To allow an ink droplet to be ejected in a larger ejection volume from such a liquid ejection head, the diameter of each ejection port needs to be further increased. However, an increased diameter of the ejection port causes the meniscus in the ejection port to be more significantly displaced in response to a fluctuation in pressure. As a result, the ejection volume fluctuation ΔVd increases, leading to the likelihood of deteriorated image quality.

Thus, in the second embodiment, the indicator ($\sqrt{(\omega/2\nu)}\times a$) for the extra-head flow path 2 is set to a value larger than 1, for example, 2 or 3 or larger. Consequently, even for the liquid ejection head with the efficient configuration, a fluctuation in the pressure of the liquid fed to the liquid ejection head can be suppressed, allowing restraint of displacement of meniscus formed in each ejection port. Thus, the volume of ink ejected through the ejection port is stabilized, enabling high-quality images to be formed.

(Third Embodiment)

Now, a third embodiment of the present invention will be described.

In the first embodiment, an example has been illustrated where the indicator for the intra-head flow path 100 is equal to or smaller than 1 ($\sqrt{(\omega/2\nu)}\times a\leq 1$) and where the radially enlarged component serving to set the indicator larger than 1 is formed at least in a part of the extra-head flow path 2. In contrast, in the third embodiment, the indicator for the intra-head flow path 100 formed in the liquid ejection head is designed to be larger than 1.

Figure 10A:
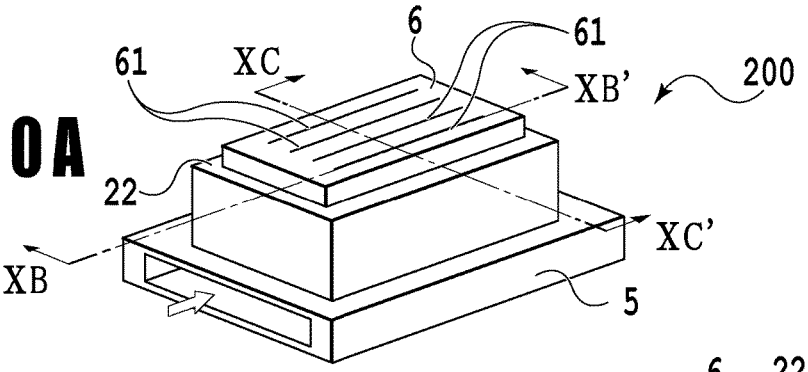
FIGS. 10A to 10D are diagrams depicting a configuration of a liquid ejection head in a third embodiment.
Figure 10B:
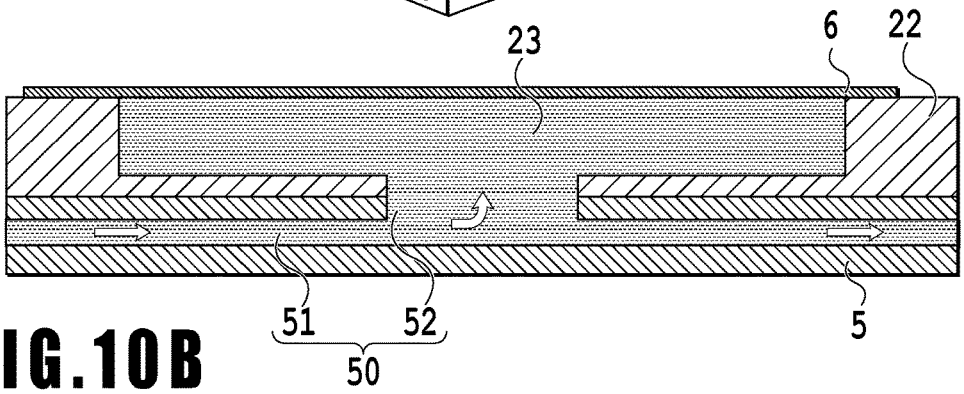
Figure 10C:
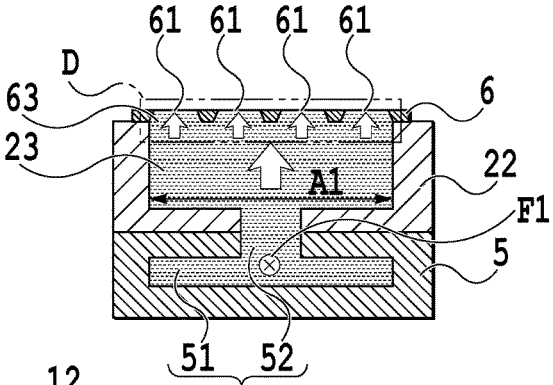

FIGS. 10A to 10D are diagrams depicting a configuration of a liquid ejection head 200 in the third embodiment. FIG. 10A is a perspective view. FIG. 10B is a sectional view taken along line XB-XB' in FIG. 10A, and FIG. 10C is a sectional view taken along line XC-XC' in FIG. 10A. Components in FIGS. 10A to 10D that are the same as or correspond to particular components of the liquid ejection head 1 depicted in FIGS. 2A and 2B are denoted by the same reference numerals and will not be described in detail.

The liquid ejection head 200 includes a printing element substrate 6 and a flow path plate 5 that are similar to those in the first embodiment, but is different from the liquid ejection head 200 in the first embodiment in that a liquid chamber member 22 is provided between the printing element substrate 6 and the flow path plate 5.

Figure 10D:
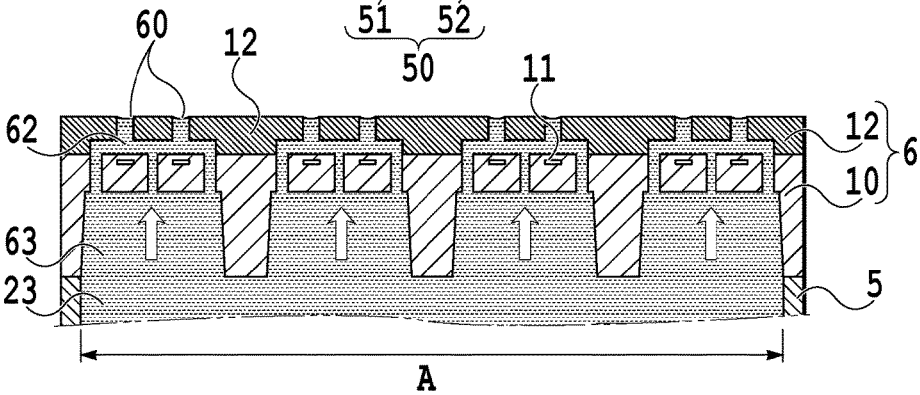

The liquid chamber member 22 has an intra-liquid-chamber flow path 23 that allows the intra-plate flow path 50 formed in the flow path plate 5 as depicted in FIG. 10B to communicate with the intra-element-substrate flow paths 63 formed in the printing element substrate 6 as depicted in FIG. 10D. A dimension A1 (see FIG. 10C and FIG. 10D) of the intra-liquid-chamber flow path 23 is much larger than the dimension A as depicted in FIG. 2A. Thus, the intra-liquid-chamber flow path 23 has a very large equivalent diameter, and the item (a) in the indicator ($\sqrt{(\omega/2\nu)}\times a$) for this flow path has a very large value. Thus, the indicator ($\sqrt{(\omega/2\nu)}\times a$) has a value substantially larger than 1. As a result, in the liquid ejection head 200 in the present embodiment, a fluctuation in pressure resulting from flow of ink allowed by the pump 3 can be suppressed by the intra-liquid-chamber flow path 23, which communicates with the printing element substrate 6. This enables restraint of displacement of meniscus formed in each ejection port 60. Thus, the volume of ink ejected through the ejection port 60 is stabilized, enabling high-quality images to be formed.

(Fourth Embodiment)

Figure 11:
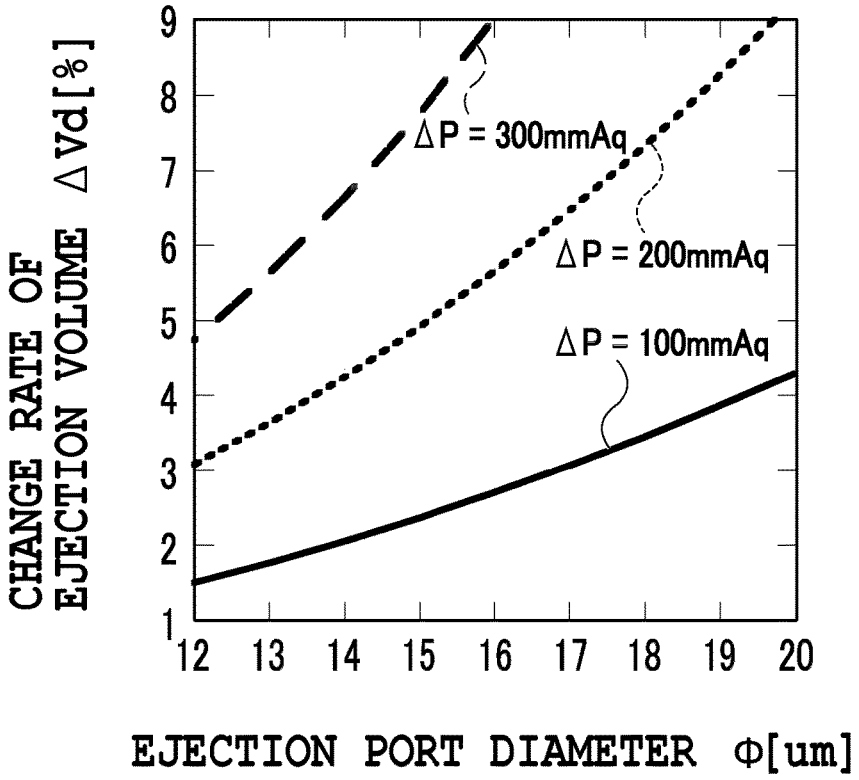
FIG. 11 is a graph illustrating a change rate of an ejection volume resulting from changes in pressure fluctuation $\Delta P$ and in ejection port diameter $\Phi$.

Now, a fourth embodiment of the present invention will be described based on FIGS. 11 to 13. FIG. 11 is a graph illustrating the change rate of the ejection volume resulting from changes in pressure fluctuation ΔP and in ejection port diameter Φ. FIG. 11 indicates that the change rate of the ejection volume increases consistently with the pressure fluctuation ΔP and ejection port diameter Φ. In other words, a pulsatile flow of ink results from an increase in pressure fluctuation ΔP, causing the meniscus in each ejection port 60 to be more significantly displaced. This increases a fluctuation in ejection volume during ejection. Thus, to suppress a pulsatile flow of ink, the indicator ($\sqrt{(\omega/2\nu)}\times a$) needs to be increased above 1.

Figure 12:
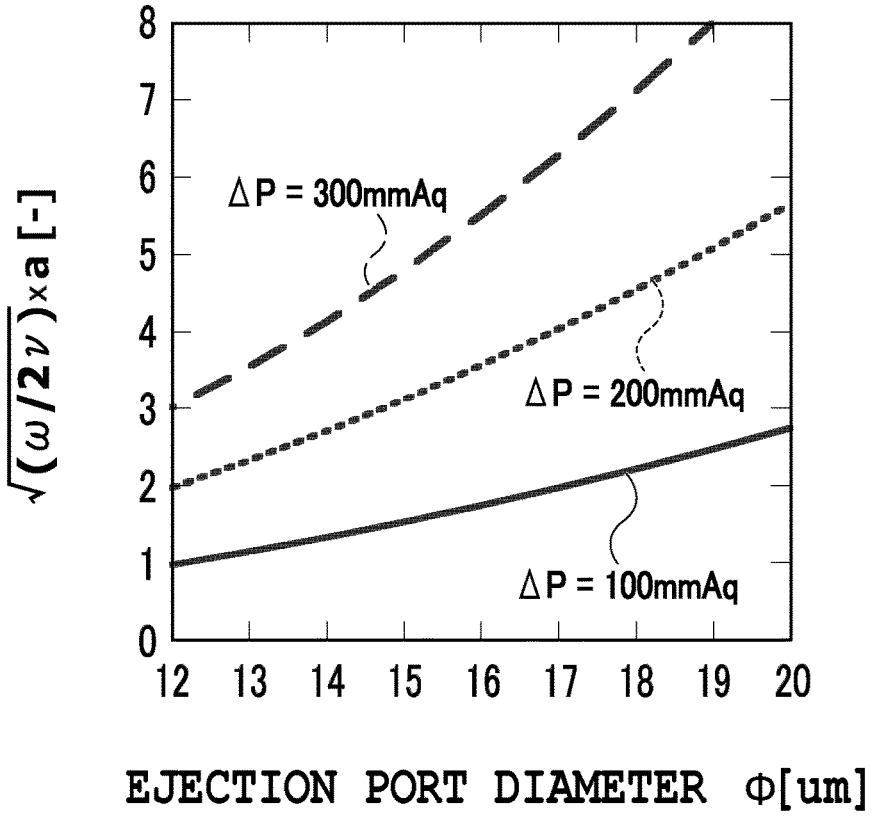
FIG. 12 is a graph illustrating the magnitude of an indicator needed to prevent the change rate of the ejection volume from increasing above 1.5%.
Figure 13:
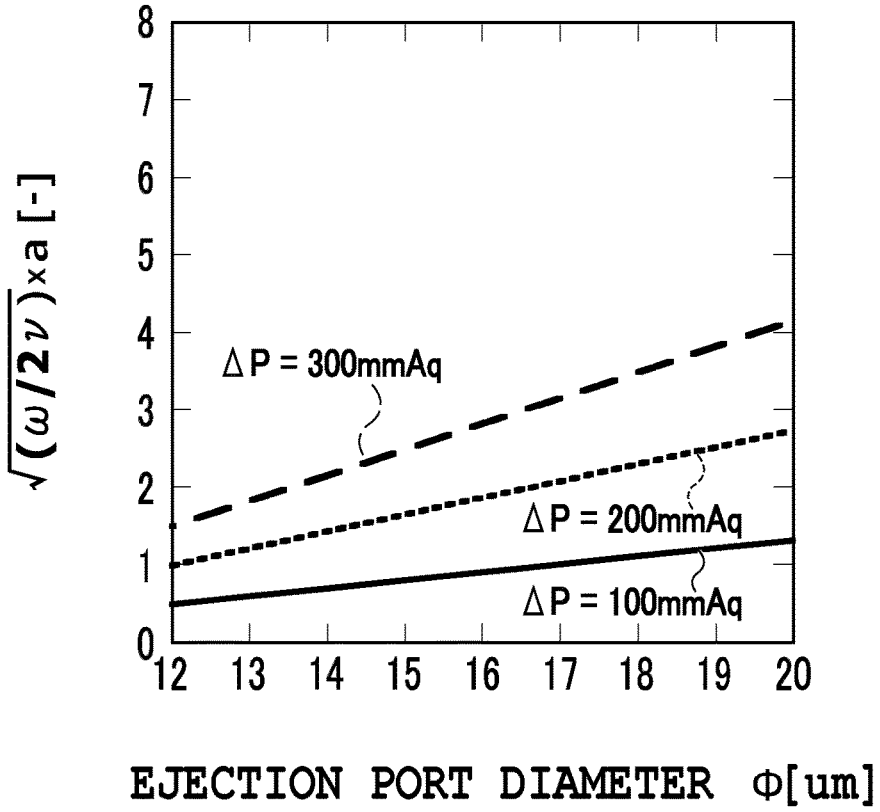
FIG. 13 is a graph illustrating the magnitude of the indicator needed to prevent change rate of the ejection volume from increasing above 3.0%.

FIG. 12 and FIG. 13 are graphs illustrating a relation between the ejection port diameter Φ and the indicator observed in a case where a pressure fluctuation ΔP has occurred. FIG. 12 illustrates the magnitude of the indicator needed to prevent the change rate of the ejection volume from increasing above 1.5%. FIG. 13 illustrates the magnitude of the indicator needed to prevent the change rate of the ejection volume from increasing above 3.0%. These figures illustrate cases where the pressure fluctuation ΔP is 100 mmAq, 200 mmAq, and 300 mmAq. As is apparent from FIG. 12 and FIG. 13, the indicator ($\sqrt{(\omega/2\nu)}\times a$) increases consistently with the pressure chambers ΔP and the ejection port diameter Φ. Therefore, to prevent the change rate of the ejection volume from increasing above 1.5% and 3.0%, a relation between pulsation of pressure of a liquid allowed to flow by the pumps and the diameter Φ of the ejection port is set as follows.

That is, to prevent the change rate of the ejection volume from increasing above 1.5, the following relation is met.

$$\sqrt{(\omega/2\nu)}\times a>\Phi(-0.0243+0.0023P)+0.2636-0.0176P \quad \text{(Equation 4)}$$

To prevent the change rate of the ejection volume from increasing above 3.0, the following relation is met.

$$\sqrt{(\omega/2\nu)}\times a>\Phi(-0.0122+0.0012P)+0.1318-0.0088P \quad \text{(Equation 5)}$$

ω: angular frequency of pulsation

ν: coefficient of kinematic viscosity of ink a: equivalent diameter of the conduit Φ: ejection port diameter of the liquid ejection head [μm]

P: pressure pulsation of a liquid delivered from a liquid delivery mechanism

In a case where the liquid ejection head, the flow paths, the pumps, and the ink are set so as to satisfy the above-described relation, the change rate of the ejection volume can be prevented from increasing above 1.5 and 3.0, enabling the ink to be stably ejected from the liquid ejection head.

The present invention represented by the above-described embodiments is applicable to liquid ejection apparatuses and liquid ejection heads in which a liquid is fed using a liquid delivery mechanism such as pumps. Therefore, the present invention is applicable both to a serial type in which print media are scanned for printing and to a full line type having a length corresponding to the width of print media. The present invention is also applicable to liquid ejection apparatuses and heads of what is called circulation type in which a liquid is fed from a tank (storage) to the liquid ejection head and then from the liquid ejection head to a tank in which the liquid is collected. The present invention is particularly suitably applicable to liquid ejection heads and liquid ejection apparatuses in which a liquid in a pressure chamber containing energy generating elements is circulated between the pressure chamber and the outside of the pressure chamber using a full-line liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-107296, filed May 30, 2016, which is hereby incorporated by reference wherein in its entirety.

What is claimed is:

1. A liquid ejection apparatus comprising:

a liquid ejection head having a printing element substrate comprising an ejection port through which a liquid is ejected and an ejection energy generating element configured to generate ejection energy for ejecting the liquid, the liquid ejection head further having a liquid chamber member configured to hold the liquid to be supplied to the printing element substrate;

a flow path configured to communicate with the ejection port; and a liquid delivery unit configured to feed the liquid to the flow path, wherein an opening for supplying the liquid to the printing element substrate is defined by a surface of the liquid chamber member on a side on which the printing element substrate is provided, the opening extending along a longitudinal direction of the printing element substrate, wherein the liquid is delivered to the flow path by the liquid delivery unit at an angular frequency of ω, and wherein the opening is constructed such that a relation between the angular frequency ω of the liquid delivered from the liquid delivery unit, a coefficient of kinematic viscosity v of the liquid, and an equivalent diameter (a) of the opening satisfies $\sqrt{(\omega/2v)}\times a>1$.

2. The liquid ejection apparatus according to claim 1, wherein the relation satisfies $\sqrt{(\omega/2v)}\times a>2$.

3. The liquid ejection apparatus according to claim 1, wherein the relation satisfies $\sqrt{(\omega/2v)}\times a>5$.

4. The liquid ejection apparatus according to claim 1, wherein a relation between a diameter Φ of the ejection port in the liquid ejection head and pressure pulsation P of the liquid delivered from the liquid delivery unit satisfies $\sqrt{(\omega/2v)}\times a>\Phi(-0.0243+0.0023P)+0.2636-0.0176P$.

5. The liquid ejection apparatus according to claim 1, wherein a relation between a diameter Φ of the ejection port in the liquid ejection head and pressure pulsation P of the liquid delivered from the liquid delivery unit satisfies $\sqrt{(\omega/2v)}\times a>\Phi(-0.0122+0.0012P)+0.1318--0.0088P$.

6. The liquid ejection apparatus according to claim 1, wherein the flow path includes an intra-head flow path formed in the liquid ejection head and an extra-head flow path connected to the intra-head flow path.

7. The liquid ejection apparatus according to claim 6, wherein the liquid ejection head has a flow path plate configured to communicate with the printing element substrate, and a flow path through which the printing element substrate communicates with the flow path plate has a larger equivalent diameter than an equivalent diameter of a flow path formed in the flow path plate.

8. The liquid ejection apparatus according to claim 7, wherein the printing element substrate includes a pressure chamber provided between the ejection energy generating element and the ejection port and to which the liquid is fed, and when the ejection energy generating element generates ejection energy, 70% or more of the liquid present in the pressure chamber is ejected through the ejection port.

9. The liquid ejection apparatus according to claim 6, wherein the liquid delivery unit is connected to the extra-head flow path.

10. The liquid ejection apparatus according to claim 1, wherein the liquid ejection head is comprised of a full-line liquid ejection head in which plural ejection ports are arranged lengthwise in correspondence to width of print media.

11. A liquid ejection head having an ejection port through which a liquid is ejected, the liquid ejection head comprising;

a printing element substrate comprising an ejection energy generating element configured to generate ejection energy for ejecting the liquid;

a liquid chamber member configured to hold the liquid to be supplied to the printing element substrate; and a flow path configured to communicate with the ejection port, wherein an opening for supplying the liquid to the printing element substrate is defined by a surface of the liquid chamber member on a side on which the printing element substrate is provided, the opening extending along a longitudinal direction of the printing element substrate, wherein the liquid is delivered to the flow path by a liquid delivery unit at an angular frequency of ω, and wherein the opening is constructed such that a relation between the angular frequency ω of the liquid delivered from the liquid delivery unit, a coefficient of kinematic viscosity v of the liquid, and an equivalent diameter (a) of the opening satisfies $\sqrt{(\omega/2v)}\times a>1$.

12. The liquid ejection head according to claim 11, further comprising a pressure chamber containing the element, wherein the liquid in the pressure chamber is circulated between the pressure chamber and an outside of the pressure chamber.

13. The liquid ejection head according to claim 11, wherein the liquid ejection head is comprised of a full-line liquid ejection head in which plural ejection ports are arranged lengthwise in correspondence to width of print media.

* * * * *